US006952864B2

(12) United States Patent
Moreno

(10) Patent No.: US 6,952,864 B2
(45) Date of Patent: Oct. 11, 2005

(54) SHOELACE RETAINER

(76) Inventor: John R. Moreno, 906 Colorado St., Victoria, TX (US) 77901

( * ) Notice: Subject to any disclaimer, the term of this patent is extended or adjusted under 35 U.S.C. 154(b) by 0 days.

(21) Appl. No.: 10/190,727

(22) Filed: Jul. 9, 2002

(65) Prior Publication Data

US 2004/0006856 A1 Jan. 15, 2004

(51) Int. Cl.[7] ..... A43C 7/00
(52) U.S. Cl. ..... 24/712.3; 24/306
(58) Field of Search ..... 24/712.1–712.3, 24/712.5, 306, 442; 36/50.1

(56) References Cited

U.S. PATENT DOCUMENTS

| | | | | |
|---|---|---|---|---|
| 3,162,920 A | | 12/1964 | Durham | 24/265 R |
| 3,947,927 A | | 4/1976 | Rosenthal | 24/306 |
| 4,044,415 A | * | 8/1977 | Wood | 441/75 |
| 4,291,439 A | | 9/1981 | Riti | |
| 4,417,710 A | | 11/1983 | Adair | 248/51 |
| 4,428,101 A | | 1/1984 | Harkavy | 24/712.4 |
| 4,553,293 A | | 11/1985 | Blum | 24/712.2 |
| 4,571,854 A | | 2/1986 | Edens | |
| 4,780,936 A | | 11/1988 | Brecher | 24/712.2 |
| 4,879,787 A | | 11/1989 | Walls | 24/712.2 |
| 4,982,885 A | | 1/1991 | Severson et al. | 224/675 |
| 4,999,888 A | | 3/1991 | Miller | |
| 5,110,023 A | | 5/1992 | Colin | 224/620 |
| 5,778,500 A | | 7/1998 | Illingworth | |
| 5,913,483 A | | 6/1999 | Polk | |
| 6,016,590 A | | 1/2000 | Malone | |
| 6,138,882 A | | 10/2000 | Buettner | 224/250 |

FOREIGN PATENT DOCUMENTS

| | | | |
|---|---|---|---|
| JP | 2001299411 A | 10/2001 | A43B/23/00 |

* cited by examiner

*Primary Examiner*—James R. Brittain
(74) *Attorney, Agent, or Firm*—Stephen R. Greiner

(57) ABSTRACT

A shoelace retainer including a strip of loop-type fastening material that has been folded back upon itself near its midpoint and seamed in place so as to form a small tab. The tab is perforated so as to provide the strip of loop-type fastening material with an attachment ring. Adjacent the ring at one end of the strip of loop-type fastening material is attached a patch of hook-type fastening material.

1 Claim, 1 Drawing Sheet

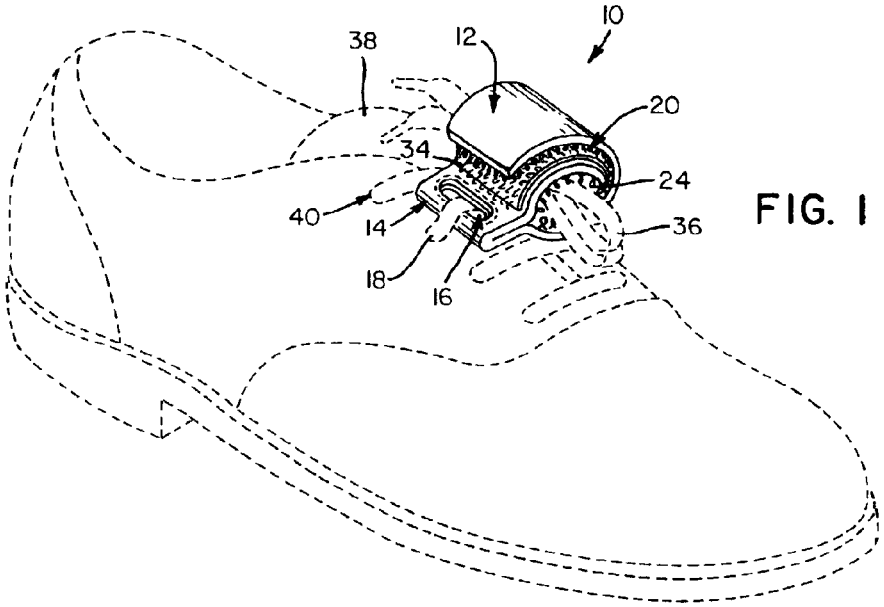
FIG. 1
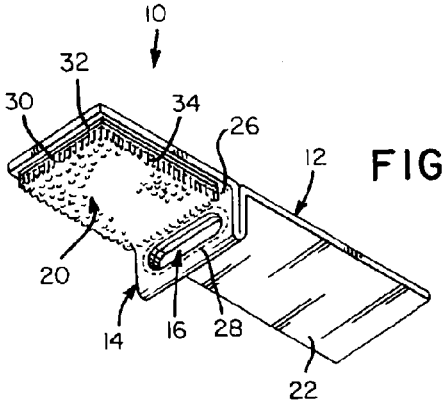
FIG. 2
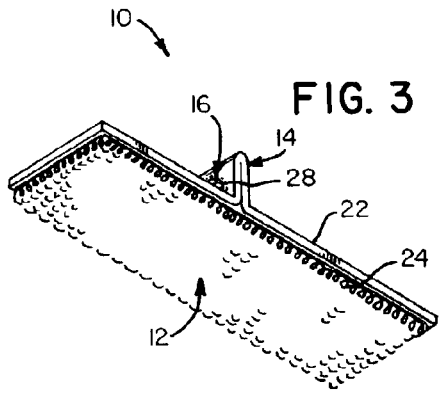
FIG. 3
FIG. 4
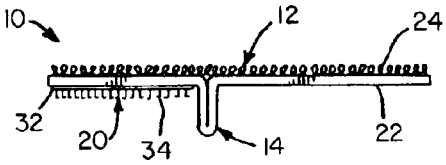

SHOELACE RETAINER

FIELD OF THE INVENTION

The present invention relates generally to drawstrings or lacings including separate devices for holding the drawn portions of lacings and, more particularly, to devices that engage ties in lacings.

BACKGROUND OF THE INVENTION

As anyone who has ever worn shoes knows, dealing with shoelaces can be a frustrating task. Shoelaces are relatively time-consuming to tie and tend to become untied, all too frequently, at inconvenient moments. Of course, untied laces cannot be ignored since they are a tripping hazard posing the risk of severe injury should they be stepped on.

Many have perceived the risk posed by untied or loose shoelaces and have proposed devices for grasping shoelaces and preventing them from becoming untied. Many of these devices have been complex and cumbersome in their construction. Others had no means to ensure that they would not become detached from a shoelace and lost. To date, none of these devices has seen widespread acceptance by consumers or great commercial success.

SUMMARY OF THE INVENTION

In light of the problems associated with the known devices for preventing shoelaces from becoming untied and swinging loose on a shoe, it is a principal object of the invention to provide a shoelace retainer of uncomplicated construction that cannot, under conditions of normal use, be lost by a wearer. It is believed that the retainer would be of great benefit to athletes involved in sporting events, businessmen, young children learning how to walk, and all people who wear shoes with laces.

It is an object of the invention to provide improved elements and arrangements thereof in a shoelace retainer for the purposes described that is lightweight in construction, inexpensive to manufacture, and dependable in use.

Briefly, the shoelace retainer in accordance with this invention achieves the intended objects by featuring a strip of loop-type fastening material folded back upon itself to form a tab. The tab is provided with a central passage through which may be extended a shoelace. Adjacent the tab, a patch of hook-type fastening material is sewn to the rear of the strip. By pressing the hooks and loops of the strip and patch together, the retainer may grasp the tied portion of shoelace preventing it from untying or swinging free.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a perspective view of a shoelace retainer in accordance with the present invention positioned for use on a shoe.

FIG. 2 is a rear perspective view of the shoelace retainer of FIG. 1.

FIG. 3 is a front perspective view of the shoelace retainer.

FIG. 4 is a side view of the shoelace retainer.

Similar reference characters denote corresponding features consistently throughout the accompanying drawings.

DETAILED DESCRIPTION OF THE PREFERRED EMBODIMENT

Referring now to the FIGS., a shoelace retainer in accordance with the present invention is shown at 10. Shoelace retainer 10 includes a strip of loop-type fastening material 12 that has been folded back upon itself near its midpoint to form a small tab 14 extending from the rear of strip 12. Tab 14 is provided with a central passage 16 through which may be extended a shoelace 18. Adjacent tab 14, a patch of hook-type fastening material 20 is sewn to the rear of strip 12.

Strip 12 comprises a piece of "Velcro" pile material having a flexible backing 22 from which extend a dense mat of small, uncut loops 24 formed of thread. Preferably, strip 12 measures about 3¼ inches (8.3 cm) in length and ¾ inch (1.9 cm) in width. Tab 14 extends rearwardly about ¼ inch (0.64 cm) from the remainder of strip 12 and a sewn seam 26 holds such in place. The passage 16 in tab 14 may be surrounded by a peripheral seam 28 for reinforcement purposes. Although seams 26 and 28 are shown for the sake of simplicity as being formed with straight stitching, such may be formed with zigzag or other types of stitching.

By means of a sewn seam 30, patch 20 is secured to one end of strip 12. Patch 20 comprises a strip of "Velcro" hook material having a flexible backing 32 from which extends a plurality of transverse lines of hooks 34 spaced along its length. The ends of hooks 34 are turned inwardly so as to catch in loops 24 when fastening portions 12 and 20 are pressed together.

Patch 20 measures about ¾ inch by ¾ inch (1.9 cm by 1.9 cm). Patch 20 may be fastened at various points along the length of strip 12 thereby permitting retainer 10 to be adjustably fastened around the tied portion 36 of a shoelace 18. Thus, retainer 10 can accommodate tied portions 36 of different dimensions.

Retainer 10 is easily attached to a shoe 38. First, the shoelace 18 of shoe 38 is partially unlaced so that at least one set of apertures 40, and preferably two sets, are free of shoelace 18. Then, both ends of shoelace 18 are extended through passage 16 in tab 14 and laced through the open apertures 40. It is now impossible to remove retainer 10 from shoe 38 without partially unlacing shoe 38. Losing retainer 10 is, thus, a difficult feat to accomplish.

After tying shoelace 18, retainer 10 may be employed to grasp and retain the tied portion 36 against shoe 38. To do this, strip 12 is first wrapped around the tied portion 36 so that loops 24 and hooks 34 overlap. Next, hooks 34 and loops 24 are firmly pressed together so that hooks 34 are caused to enter and grasp loops 24 thereby securing strip 12 around the tied portion 36 of shoelace 18. Shoe 38 can now be worn in the usual way but with the tied portion 36 of shoelace 18 being snugly grasped by retainer 10, shoelace 18 cannot swing free or become inadvertently untied.

Release of shoelace 18 from retainer 10 is affected by grasping the end of strip 12 overlapping patch 20 and pulling it away shoe 38. The pull will cause hooks 34 and loops 24 to disengage. The transverse line of disengagement will progress lengthwise of the interlocked portions of strip 12 and patch 20 so that they will separate smoothly. Shoelace 18 may now be untied and shoe 38 may be removed from the foot of a user. Retainer 10, being compact in size, remains in place on shoe 38 for storage, transport and subsequent reuse. Retainer 10 is always ready-to-use.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A shoelace retainer, comprising:

a strip of loop-type fastening material having a first flexible backing from which a plurality of uncut loops of thread extend, said strip being folded back upon itself and sewn so as to form an outwardly extending tab, said tab being provided with an unlined central passage, and said strip having opposed ends remote from said tab; and, a patch of hook-type fastening material having a second flexible backing from which a plurality of transverse lines of hooks extend, said patch extending from said tab to one of said opposed ends of said strip, said patch being sewn to said strip such that said first flexible backing and said second flexible backing abut one another, said hook-type fastening material being adapted to mate with and releasably adhere to said loop-type fastening material when said hooks are pressed into said loops.

* * * * *